US006938454B2

(12) United States Patent
Strasser et al.

(10) Patent No.: US 6,938,454 B2
(45) Date of Patent: Sep. 6, 2005

(54) PRODUCTION DEVICE, ESPECIALLY A BENDING PRESS, AND METHOD FOR OPERATING SAID PRODUCTION DEVICE

(75) Inventors: Hagen Strasser, Pasching (AT); Helmut Theis, Pfarrkirchen (AT); Thomas Bongardt, München (DE); Georg Wünsch, München (DE)

(73) Assignee: TRUMPF Maschinen Austria GmbH & Co. KG., Pasching (AT)

( * ) Notice: Subject to any disclaimer, the term of this patent is extended or adjusted under 35 U.S.C. 154(b) by 0 days.

(21) Appl. No.: 10/986,339

(22) Filed: Nov. 11, 2004

(65) Prior Publication Data

US 2005/0097940 A1 May 12, 2005

Related U.S. Application Data

(63) Continuation of application No. PCT/AT03/00060, filed on Feb. 27, 2003.

(30) Foreign Application Priority Data

May 13, 2002 (AT) ..... A 731/2002

(51) Int. Cl.[7] ..... B21J 13/10

(52) U.S. Cl. ..... 72/420; 72/17.3; 72/31.12; 72/389.3; 72/422; 72/461; 901/47; 414/225.01; 414/752.1; 700/259

(58) Field of Search ..... 72/17.3, 18.1, 72/31.12, 389.1, 389.3, 419, 420, 422, 428, 72/461; 901/6, 15, 46, 47; 414/225.01, 627, 414/781, 783, 784, 749.1, 751.1, 752.1; 700/229, 700/259; 198/468.2, 468.4

(56) References Cited

U.S. PATENT DOCUMENTS

| | | | | |
|---|---|---|---|---|
| 4,706,491 | A | 11/1987 | Sartorio | |
| 5,182,936 | A | 2/1993 | Sartorio | |
| 5,727,415 | A * | 3/1998 | Alitalo | 72/389.3 |
| 5,748,854 | A * | 5/1998 | Watanabe et al. | 700/258 |
| 5,761,940 | A | 6/1998 | Moore, Jr. et al. | |
| 6,067,862 | A | 5/2000 | Murray et al. | |
| 6,192,297 | B1 * | 2/2001 | Marobin | 700/245 |
| 6,269,677 | B1 | 8/2001 | Torvinen et al. | |
| 6,374,158 | B1 * | 4/2002 | Fusaro, Jr. | 700/254 |
| 6,474,131 | B2 * | 11/2002 | Torvinen et al. | 72/461 |
| 6,644,080 | B2 * | 11/2003 | Lindstrom | 72/19.4 |
| 6,722,178 | B1 * | 4/2004 | Ito et al. | 72/420 |
| 6,816,755 | B2 * | 11/2004 | Habibi et al. | 700/259 |

FOREIGN PATENT DOCUMENTS

| | | |
|---|---|---|
| AT | 402 372 B | 3/1997 |
| EP | 0 125 331 A1 | 11/1984 |
| EP | 0 914 879 A1 | 5/1999 |
| EP | 1 222 975 A2 | 7/2002 |
| WO | WO 00/61315 | 10/2000 |

OTHER PUBLICATIONS

International Search Report for PCT Application No. PCT/03/00060, Filed Feb. 27, 2003; Date of Completion Oct. 3, 2003; Date of Mailing Oct. 20, 2003.

* cited by examiner

*Primary Examiner*—Ed Tolan
(74) *Attorney, Agent, or Firm*—Alston & Bird LLP

(57) ABSTRACT

A manufacturing system for folding sheet bars, particularly sheet metal bars, comprising a folding press with two press beams, which are adjustable in relation to each other and provided with folding dies, whereby the folding press is fed by means of an automated manipulating system. The manipulating system has three hinged arms connected via pivoting devices to form an arrangement of hinged arms. A first hinged arm is swivel-mounted on a swivel axle extending in a swivel device parallel to a guide track of a linearly displaceable chassis. A second and a third swivel axles supporting the hinged arms are arranged extending parallel to the swivel axle of the swivel device. A gripping system and a seizing device for picking up the sheet bars are arranged in another end area of the hinged-arm arrangement. A positioning device assures that the sheet bar is correctly positioned for the folding process.

15 Claims, 9 Drawing Sheets

PRODUCTION DEVICE, ESPECIALLY A BENDING PRESS, AND METHOD FOR OPERATING SAID PRODUCTION DEVICE

CROSS-REFERENCE TO RELATED APPLICATION

This application is a continuation of International Patent Application No. PCT/AT03/00060 filed on Feb. 27, 2003, the disclosure of which is incorporated herein by reference.

BACKGROUND OF THE INVENTION

The invention relates to a manufacturing system in the form of a bending press or folding press, as well as to a method for operating such a manufacturing system.

A folding press with a manipulating device and a method for the automated folding of sheets of metal are known from document EP 0 914 879 A1. The manipulating device is adjustable in this connection on a chassis in the direction of the longitudinal expanse of the folding beams, and equipped with gripping devices for picking up and feeding the sheets of metal and for folding the latter between the folding dies. Provision is made for sensors for correctly positioning the sheets of metal and for controlling the correct position of the sheets of metal, and the folding process is controlled by means of the signals of said sensors.

A method and a device for inserting workpieces between the folding dies of a folding press with a manipulating device and with sensor-controlled adjustment of the position and control of the position of the workpiece are known from document U.S. Pat. No. 5,761,940 A. According to said method, and by means of the device inserting the workpiece for a folding operation, provision is made on the folding press for measuring systems equipped with pressure sensors, which are adjustable on a backside of the folding dies in at least two coordinate directions, and each provided with a scanning pin for resting against a stop edge of the workpiece. For positioning the workpiece, provision is made for at least two of such measuring systems, with scanning pins spaced from each other in the direction of the longitudinal expanse of the folding dies for scanning the stop edge of the workpiece, which is driven against the scanning pins for resting against the latter. Each measuring system is fitted with a sensor measuring the force, which is acted upon by the scanning pin via a lever arrangement, and the force with which the workpiece and any deviation from an intended position preset by the scanning pins are detected in this way, so that the position of the workpiece is corrected by means of the manipulating device if the measured values differ, until identical measured values are present on the measuring systems, and thus a position of the stop edge preset with respect to the folding plane is obtained, and reshaping of the workpiece by folding can thus be carried out on the workpiece with the latter in the correct position. The adjustment and control process requires high mechanical as well as controlling and regulating expenditure for the positioning process executed by the manipulating device.

A folding press that can be operated by a manipulator for a sheet folding process, and a method for positioning the sheet before it is inserted between the folding dies, are known from document U.S. Pat. No. 4,706,491 A. According to said document, a fixed stop is provided on the folding press on the front side, and the sheet is placed against said stop, whereby said stop is forming a reference position for the displacement of the manipulator for adjustments.

For feeding workpieces to a folding press by means of a manipulator, a detector device mounted on the manufacturing system is known from AT 402 372 B. The position of an edge of the workpiece with respect to parallelism in relation to a working plane is measured by means of said detector device, and if an angular position is detected to have occurred, readjustment is carried out by the manipulator. Based on the reference position so determined, the subsequent folding operations are carried out by computing the position and repositioning. The accelerative forces occurring as the workpiece is being driven into the folding position may cause the workpiece to be displaced in the gripping system when it is finally positioned between the folding dies, which may cause inaccuracies in the course of the folding process as well.

BRIEF SUMMARY OF THE INVENTION

The problem of the invention is to provide a manufacturing system with automated feed of the workpieces for carrying out exact folding processes, and for minimizing the cycle time.

In accordance with one embodiment of the invention, this problem is addressed by a folding press that includes a manipulating device for placing the sheet workpieces into the space between the folding dies of the press. The manipulating device comprises a rotating unit and a gripping device and is displaceable on a guiding arrangement in the direction of a longitudinal axis of the press beams. The manipulating device more particularly comprises three hinged arms connected via swiveling devices to form a hinged-arm arrangement, wherein an end of a first hinged arm is pivot-mounted by a swiveling device mounted on a linearly displaceable chassis of the guiding arrangement such that the first hinged arm is pivotable about a swivel axle extending parallel to a guiding track of the guiding arrangement. A second and a third swivel axle of the swiveling devices supporting the hinged arms are arranged extending parallel to the swivel axle of the swiveling device on the chassis. The rotating unit, having a rotation axle extending perpendicularly to the swiveling axles, is arranged in another end area of the hinged-arm arrangement. An image acquisition system is arranged in the end area of the hinged-arm arrangement, the acquisition system comprising at least one image-acquiring means and at least one illumination system and one laser for identifying and recognizing the workpieces. The positioning device is formed by a stop device with at least two stop fingers adjustably arranged on a backside of the folding dies facing away from the manipulating device in a plane disposed parallel to the folding plane and in the vertical direction in relation to said plane, the stop fingers having finger carriers and finger inserts adjustable in said finger carriers to a spacing in relation to sensors measuring said spacing.

The surprising benefit of this arrangement is that no highly demanding positioning requirements have to be satisfied in readying the sheets, so that a simple feeding and depositing system suffices, which in turn permits achieving a simplification of the system, and seizing of the sheet can be based on greater tolerances owing to exact final positioning of the sheet in the stop device. Furthermore, this brings about a simplified control sequence for the manipulating system, and thus a reduction in the cycle time combined with high positioning accuracy.

In other embodiments of the invention for achieving the lowest possible manufacturing tolerances, the sheet is aligned by preliminary positioning with subsequent final positioning against a fixed stop.

However, other embodiments are advantageous as well in that they permit maintaining narrow tolerance limits when the sheet bar is picked up by the gripping system, while the sheet bar to be seized is checked at the same time for conformity with the sheet bar data stored in the controlling and monitoring system, in order to detect any deviation already prior to the folding process, and to eliminate defective or incorrectly readied sheets, if any. Rough and fine recognition are carried out in subsequently following steps, whereby the spacing of the gripper arm of the manipulating system is fixed for positioning for the processing of the images by means of cross laser technology and the triangulation calculation technique. By using an illumination unit comprising one or more illuminating heads, which illuminate the sheet bar from a number of different angular directions per image for acquiring multiple images of the sheet bar, the effects of different reflections caused by the condition of the surface of the sheet bar are eliminated to the greatest possible extent upon generation of an overall image by superimposing the individual images in the computer, which provides the line of the contour of the sheet bar, or of a part area of the latter with the reproducibility required for detecting the position. Further very advantageous embodiments for eliminating interfering reflections and influences of foreign light comprise application of a band-pass filter in order to delimit the frequency range to narrow limits, or of polarized light with a polarizing filter on the lens of the camera. Such embodiments each assure high quality of the image, and detection errors are effectively avoided in this manner.

Advantageous further developments of the invention are also disclosed providing unrestricted rotational movement of the gripping system, combined with reliable signal, energy and/or media transmission.

Furthermore, the invention relates to a method for operating a folding press.

The problem of the invention includes providing a method for operating a manufacturing system by which a simplified process for feeding sheet bars readied for the folding process to a folding press is obtained for achieving a short cycle time combined with high positioning accuracy.

In accordance with one embodiment of the invention, by carrying out the positioning process in two steps, tolerances during pick-up of the sheet bar with the gripping system are compensated in a first step by measuring and computing an angular position, and regulating such angular position of the gripping system by means of the rotating unit, and in a second step by applying the sheet bar against the fixed stops positioned in accordance with the data preset in the program, which means that the sheet bars do not need to be intermediately deposited after they have already been exactly positioned before they are seized. Furthermore, the gripping system needs not to be released in the meantime, or the holding force of the gripping system does not have to be reduced, because the tolerances achieved with respect to the final position are within a range that is compensated by the elasticity of the gripping means holding the sheet bar, such as, for example the suction cups of a vacuum gripper, or the elastic inlays or intermediate layers of tong grippers, magnetic grippers or the like.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein;

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
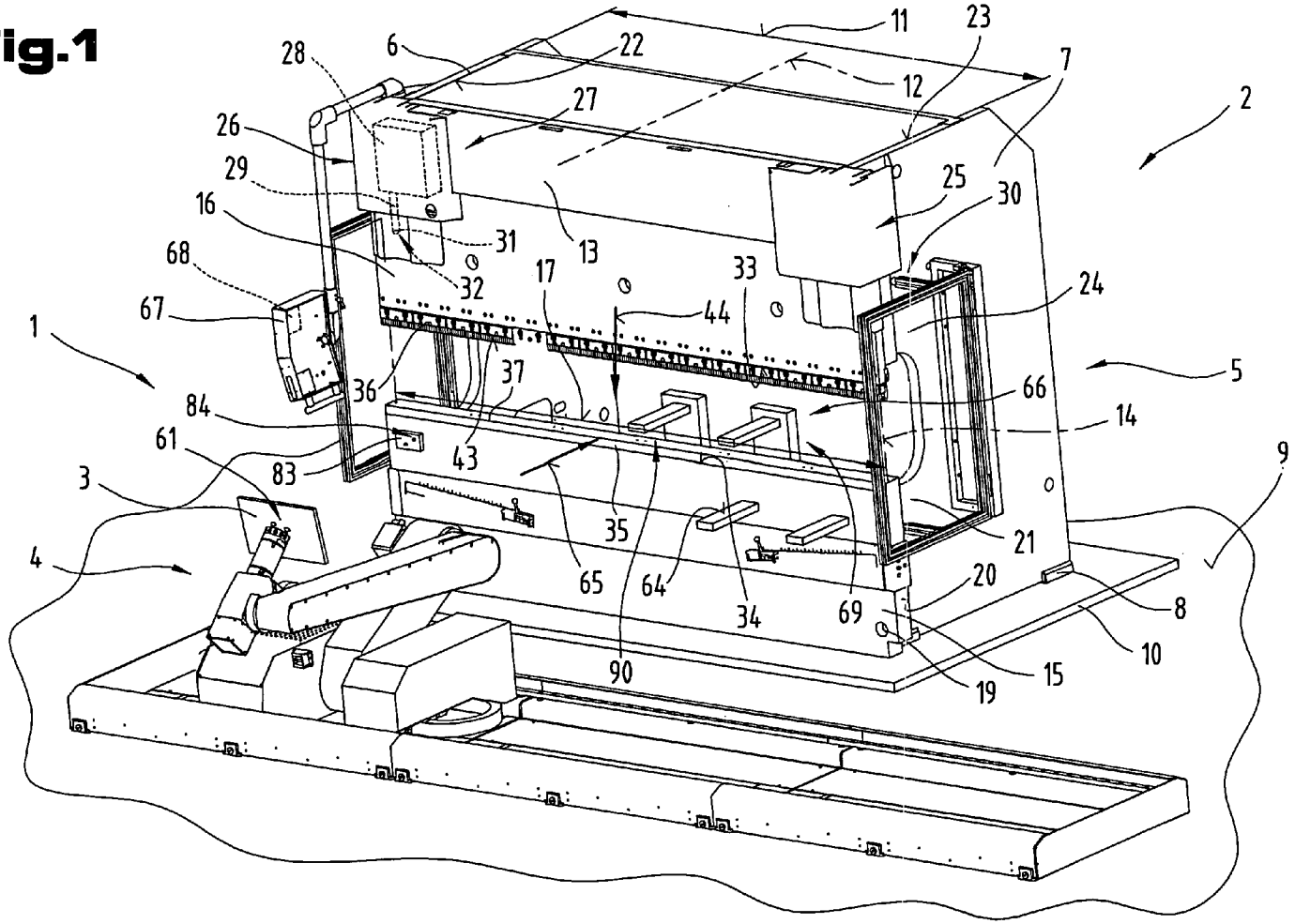
FIG. 1 is a schematic representation of the manufacturing system as defined by the invention.
Figure 2:
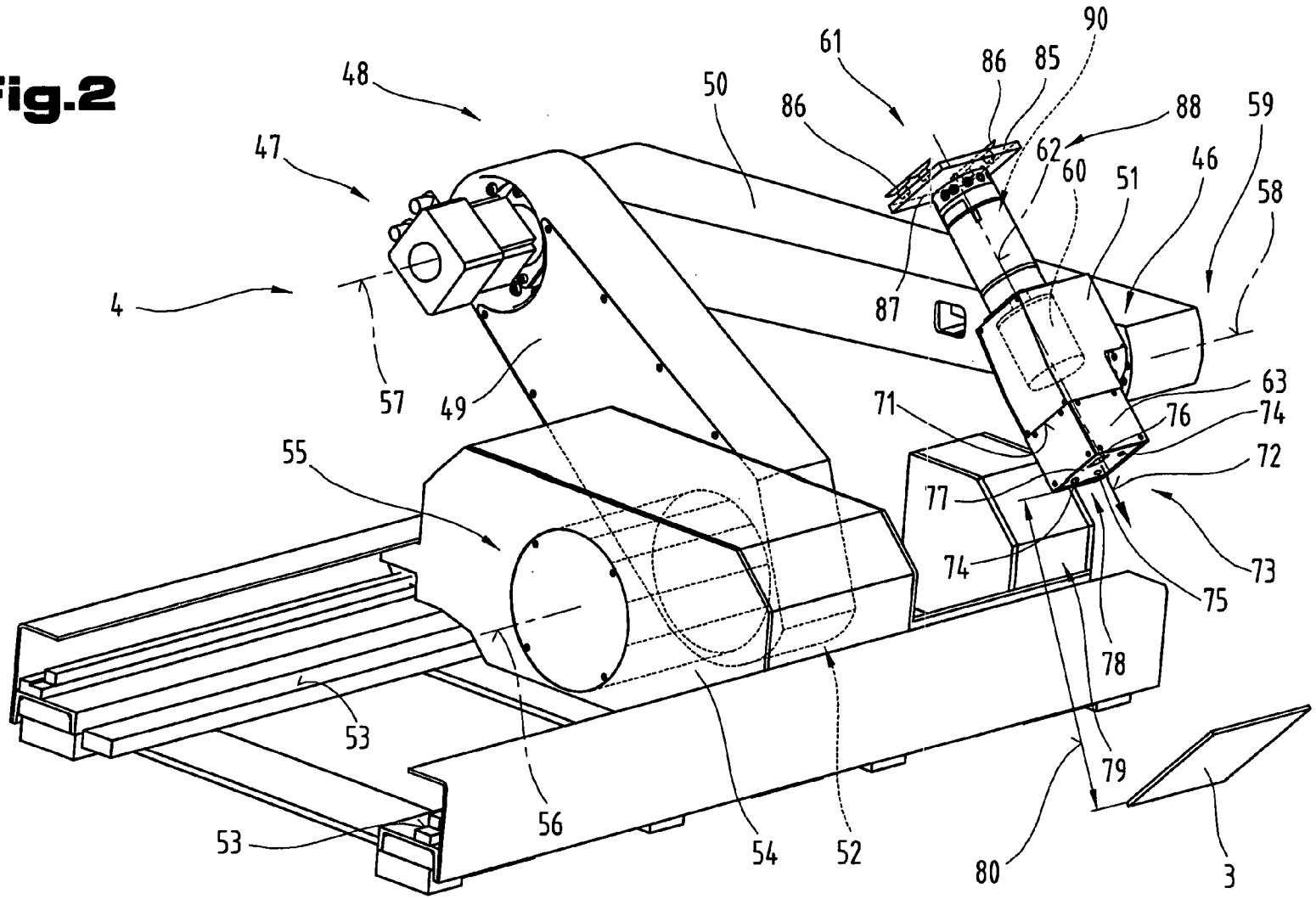
FIG. 2 is a schematic representation of the manipulating system of the manufacturing system as defined by the invention.

FIGS. 1 and 2 show a manufacturing system 1 comprising a folding press 2 for reshaping particularly the sheet bars 3, for example into components of housings or sections etc., and a manipulating device 4. Such manufacturing systems 1 are entirely utilizable as well for producing long sections, U-profiles, Z-profiles etc., generally having a very high length-to-cross-section ratio.

A machine frame 5 of the manufacturing system 1 is substantially comprised of two C-shaped, upright side plates 6 and 7, which are arranged parallel to one another with a spacing in between. Said side plates 6 and 7 are directly supported on a set-up surface 9, or supported, for example via the damping elements 8, or secured on a common floor or base panel 10, particularly welded to the latter, as shown by way of example in another embodiment. Furthermore, the upright side plates 6, 7 are connected with one another with a spacing 11 in between via the wall parts 13 extending perpendicular to a center plane 12.

With respect to the folding plane 14 extending perpendicular to the set-up surface 9, the manufacturing system 1 comprises the two press beams 15 and 16 opposing one another and extending over the length 17, said length generally being fixed by the size intended for the machine, or the working length desired for folding the sheet bar 3.

The press beam 15 facing the set-up surface 9 is secured on the machine frame 5 via a fastening arrangement 19 preferably directly on the front surfaces 20 of the legs 21 of the C-shaped side plates 6, 7 associated with the floor panel 10, particularly by means of a welded connection. The setting drives 25 and 26 of the driving arrangement 27, which is formed by the double-action hydraulic cylinders 28, are arranged on the side surfaces 22 and 23 of the legs 24 of the C-shaped, upright side plates 6 and 7, said legs being spaced from the set-up surface 9. The setting elements 29, for example piston rods of the hydraulic cylinders 28, are drive-connected with the press beam 16 via the ball-and-socket joints 31 and, e.g. the bolts 32, said press beam being adjustably supported in the folding plane 14 in the guide arrangements 16. The press beams 15 and 16 extend over the length 17 about symmetrically and in the vertical direction relative to the center plane 12, whereby the length 17 is slightly greater than the spacing 11.

On the front surfaces 33 and 34, which face one another and extend parallel to the working plane 14, the press beams 15 and 16 have the die-receiving means for supporting and detachably securing the folding dies 36 and 37. It is known from the prior art that such folding dies generally form a drop-type die designed in the form of a matrix or lower die, and a bending punch designed in the form of an upper or counter die. Furthermore, it is known from the prior art to divide the folding dies 36 and 37 into sections, which results in easy variability for the die length in order to be able to adapt the dies to the given requirements, or also to allow easier refitting of the manufacturing system 1, or to permit easier exchange of the folding dies 36 and 37.

The die-receiving means 35 in the press beams 15 and 16 are designed for detachably securing the folding dies 36 and 37, on the one hand, and they form the supporting surfaces 43 for transmitting the folding forces (as indicated by the arrow 44), on the other hand.

It is particularly shown in FIG. 2 that the manipulating device 4 is substantially comprised of the hinged devices 46 and 47 with the hinged arms 49, 50, 51 forming a pivot arm arrangement 48, whereof a hinged arm 49 is pivot-mounted in an end area 52 on a chassis 54 that is linearly displaceable parallel to the working plane 14 on the laterally and vertically guiding tracks 53, said hinged arm 49 swiveling about a pivot device 55, whereby a swivel axle 56 is expending parallel to the folding plane 14. A second and a third swivel axle 57, 58 of the pivot devices 46, 47 supporting the hinged arms 49, 50, 51, extend parallel to the swivel axle 56. A rotational system 60 with a gripper system 61 is arranged in another end area 59 of the hinged-arm arrangement 48, whereby the rotational system 60 is forming a rotation axle 62 extending perpendicular to the swivel axles 56, 57, 58. Furthermore, a detection system 63 for identifying and recognizing the position of the sheet bars readied on a depositing means or supplied by a feeding system, is secured on the hinged arm 51.

Furthermore, the manufacturing system 1 comprises a support device 64 arranged on the stationary press beam 15 for receiving and supporting the sheet bars 3, which are removed from said support device 64 by the gripping system 61, or are deposited in said support device to be gripped there and removed from it.

Furthermore, in the direction of feed (as indicated by the arrow 65) of the sheet bars 3, a positioning system 66 for the sheet bar 3 or workpiece is arranged downstream of the working plane 14. Said positioning system is line-connected with a controlling and monitoring system 67 or position-regulating element 68 of the controlling and monitoring system 67, and adjustably supported on the machine frame 5 for adjustment in a plane parallel to the folding plane 14, and in a direction perpendicular to said folding plane in an adjusting system 69. A driving arrangement of the adjusting system 69 is designed in the form of a positioning drive, by means of which the positioning system 66 can be driven into the predetermined position via positioning data preset by the controlling and monitoring system 67 in accordance with the manufacturing or production program for detecting and positioning the sheet bar 3 or workpiece for the folding process.

Furthermore, FIG. 2 shows the detection system 63, which is arranged in a position defined in relation to the gripping system 61 in an end area 59 of the pivot-arm arrangement 48 or the hinged arm 51. The detection system 63 is preferably secured on a front surface 71 of the hinged arm 51, said front surface being arranged opposite the rotational system 60 for the gripping system 61. The direction of action indicated by the arrow 72 for receiving information about the sheet bar such as about its contour, position etc., is thus exactly opposing the direction of action of the gripping system 61.

The detection system 63 comprises an image detection means, preferably a camera 73 for rough recognition, and a camera 74 for fine recognition, as well as, furthermore, a diode laser 75 and an illumination system 76 for emitting light flashes in the infrared frequency range by means of the light-emitting diodes (LED's) 77.

The rough-recognition camera 73 preferably operates within a range of distance between the sheet bar 3 and the rough-recognition camera 73 of about 500 mm and 2,000 mm. The fine-recognition camera 74 operates at a distance of about 300 mm. The data required for positioning the detection system at the spacing intended for both rough and fine recognition are determined by means of triangulation calculation based on a laser cross projected onto the sheet bar 3 with the diode laser. The camera 73 for rough recognition and the camera 74 for fine recognition are equipped with the different lenses 78 according to the effective spacing. Rough and fine recognition of the sheet bar 3 is accomplished based on CAD (computer-aided design) data from the planning or design stage, which are stored in a computer 79 of the controlling and monitoring system 67. Patterns are generated from said data. The corresponding pattern is searched in the recorded image and, if corresponding, the position of the sheet bar 3 is determined in the subsequent fine recognition after the pivot arm arrangement 48 has been set to a position for fine recognition.

In order to grip the sheet bar in the exact position, processing of the image has to satisfy special requirements. The illuminating system 76 and the evaluation method are important in this connection. Several LED illumination units are basically arranged for the illuminating system 76. In the exemplified embodiment, three such LED illumination units 77 are arranged on the detection system 63, which subsequently illuminate the sheet bar with light flashes in fields of light radiation extending at angles relative to each other, and detect per activated LED illumination unit 77 an image of the sheet bar 3, or of a cutout of the latter with the camera 74 for fine recognition. The three digital images generated in the concrete exemplified embodiment are then generated in the computer 79 into a summary image. Owing to the angular alignment of the field of light radiation for illuminating the sheet bar 3 and generating the digital image, as well as due to the formation of a summary image from the individual images, reflections and influences of scattered light are eliminated to the greatest possible extent, whereby it is naturally possible, furthermore, to realize other variations such as, for example application of light within a narrow infrared wavelength of about 820 to 880 nm; the arrangement of a band-pass filter on the camera 74 for fine recognition, but also to implement other measures for detecting the exact position and for generating the position data for seizing the sheet bar with the gripping system. One of such further possibilities for avoiding disturbing light reflections is linear polarization of the emitted light. The directly reflected light maintains its direction of polarization and is filtered out with the help of a analyzer turned by 90° on the lens 78 of the fine-recognition camera 74, whereby diffuse light can pass unobstructed.

The determination of the position by means of fine recognition of the sheet bar 3 now permits exact acceptance or exact placement of the gripping system 61 on the sheet bar 3, in the way it is required for positioning the sheet bar 3 in the folding press 2 for carrying out a folding operation. In addition, the spacing between the detection system 63 and the folding press 2 can be calibrated with the detection system 63. Such calibration is accomplished by means of a calibrating plate 83 arranged on the folding press 2, said plate being provided with, for example the marking dots 84 having a defined size and defined spacing between each other. By comparing the size and spacing ratio of the marking dots, which have different sizes per spacing, with the predefined values stored in the computer 79, as well as with the help of the position of the individual marking dots 84, a reference position is determined in the X- and Y-directions, and the required adjustment of the manipulating device 4 is controlled in order to bring the sheet bar 3 into the position in which it is worked.

Furthermore, provision is made according to another embodiment for using the detection system 63, particularly the camera 74 for fine recognition for die recognition, or for checking the data of the set of dies employed in the folding press 2 at the given time. For this purpose, the folding dies 36, 37 are provided with coding characters that are compared to codes stored in the controlling and monitoring system 67.

It should be mentioned, furthermore, that also after the sheet bars 2 have been deposited following a preceding folding operation, the finished workpieces are transported away on readied pallets by means of the detection system 63 in order to ready the press for subsequent folding operations, and the sheet bar 3 is gripped again as required by the gripping system 61 by depositing it on the support device 64, and re-positioning it with respect to the new gripping position of the gripping device, as described above overall for the positioning process.

In the exemplified embodiment shown in FIG. 2, the gripping system is formed by a vacuum gripping system 85, which is comprised of the gripper plate 76, which is fitted with the suction cups 86 with the required supply channels, and rotationally coupled via a rotational transmitter for endlessly revolving with the rotational system 60 of the hinged arm 51. The rotation transmitter 88 is provided with the transmission elements 89 for transmitting energy and/or controlling and monitoring signals, and designed for a pressure medium such as, for example compressed air for applying a vacuum for the vacuum gripping system 85. By interconnecting the rotation transmitter 88, it is possible to supply the vacuum gripping system 85 with the required compressed air and also with vacuum, and provision can be made for sensors, if needed, in order to assure interruption-free transmission of controlling and/or monitoring signals to the controlling and monitoring system 67 of the manufacturing system 1. The rotational transmitter 89 is preferably provided with bus capability; an AS-i-bus system is preferably employed. Provision is made for a multi-pole, but at least two-pole design for electrical energy transmission.

As shown in the exemplified embodiment, the gripping system 61, the latter being formed by a vacuum gripping system 85, can naturally be employed in other design variations as well. For the manufacturing system 1 as defined by the invention, the gripping system 61 naturally can be realized also in the form of a tong gripper, magnetic gripper etc.

Figure 3:
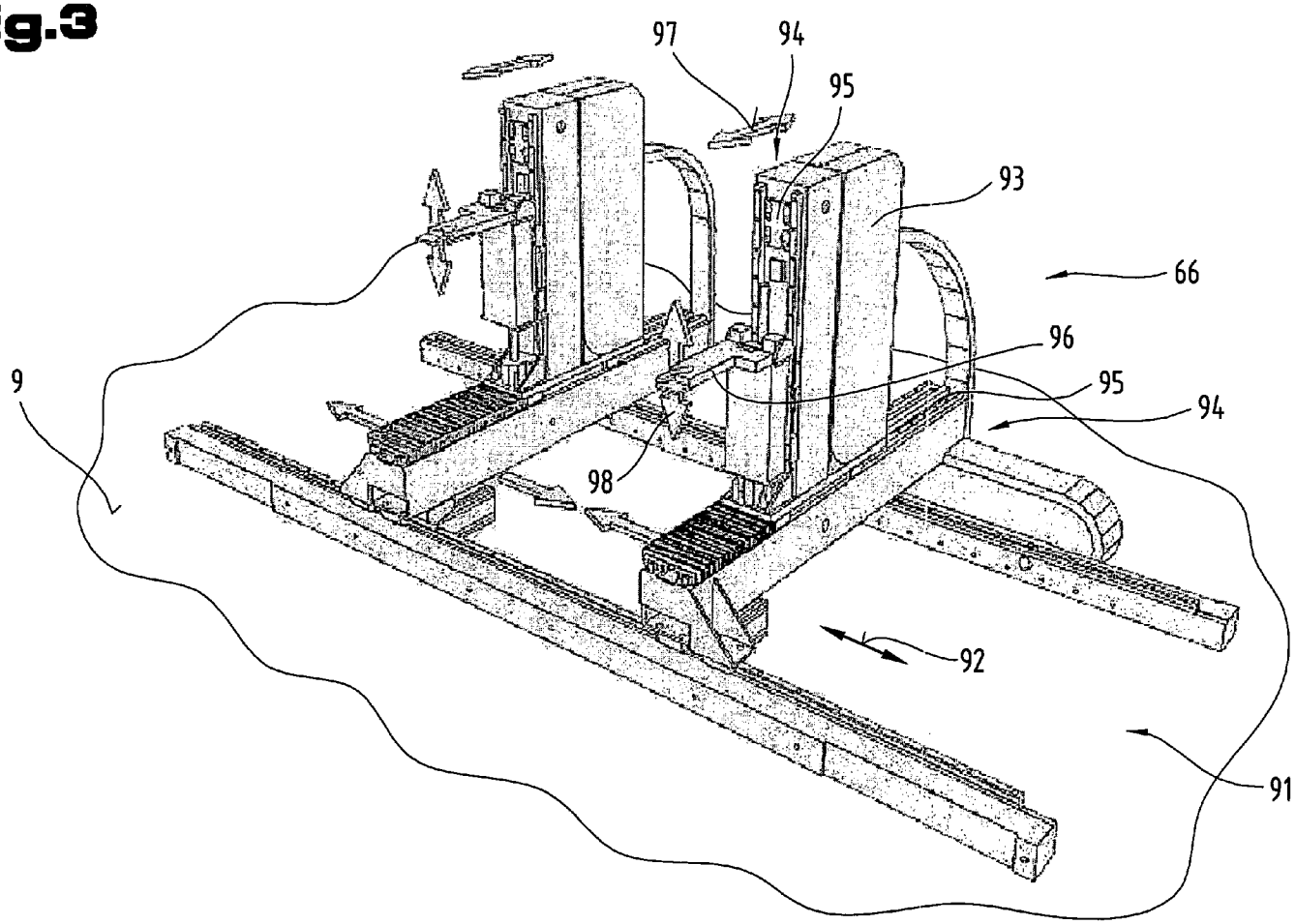
FIG. 3 is a schematic representation of the positioning system of the manufacturing system as defined by the invention.

FIG. 3 shows a realizable design of the positioning system 66 for positioning the sheet bar 3 for carrying out a folding operation. Said positioning system is formed by a stop device 90 comprising at least two setting units 93, which are displaceable independently of each other on a guide arrangement 91 in the direction of the longitudinal expanse of the folding dies as indicated by the double arrow 92. Furthermore, each setting unit 93 is equipped with a carriage arrangement 94 and an advancing device 95, by which a stop finger 96 projecting in the direction of the folding plane 14 can be adjusted perpendicularly to the folding plane 14 as indicated by the double arrow 97, and in the direction extending perpendicularly to the set-up surface 9 as indicated by the double arrow 98. This provides the stop finger 96 with the capability of moving along three axes.

Figure 4:
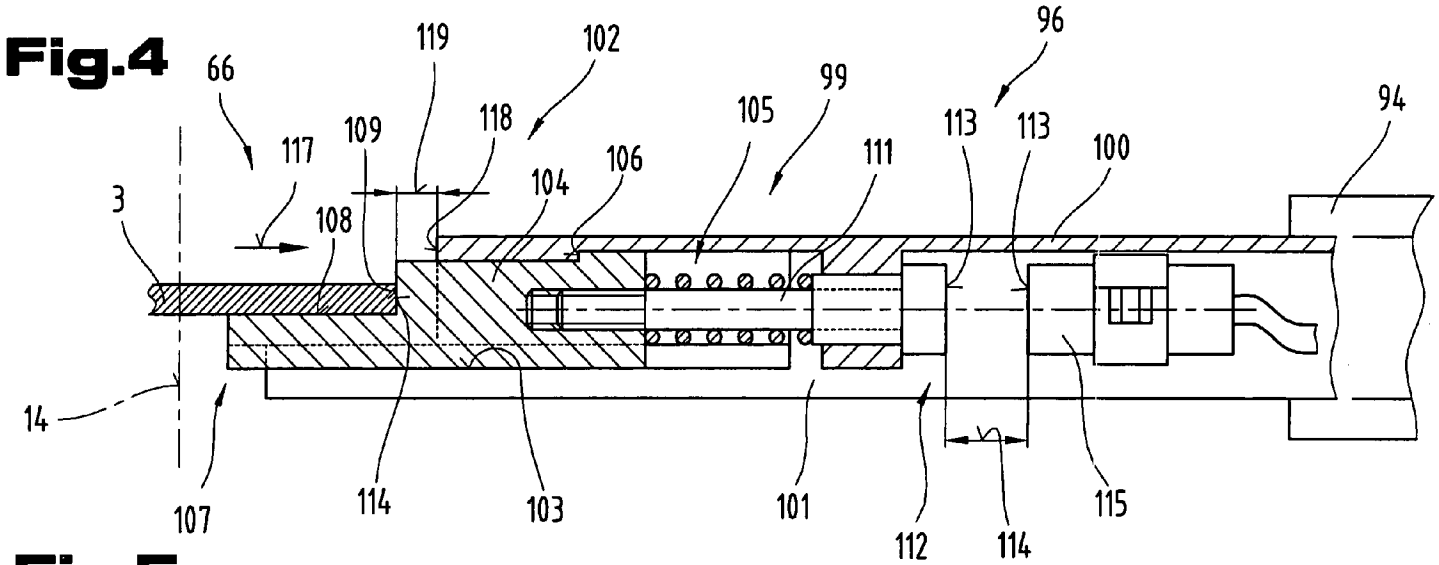
FIG. 4 is a sectional view of a detail with a section according to lines IV—IV in FIG. 5.
Figure 5:
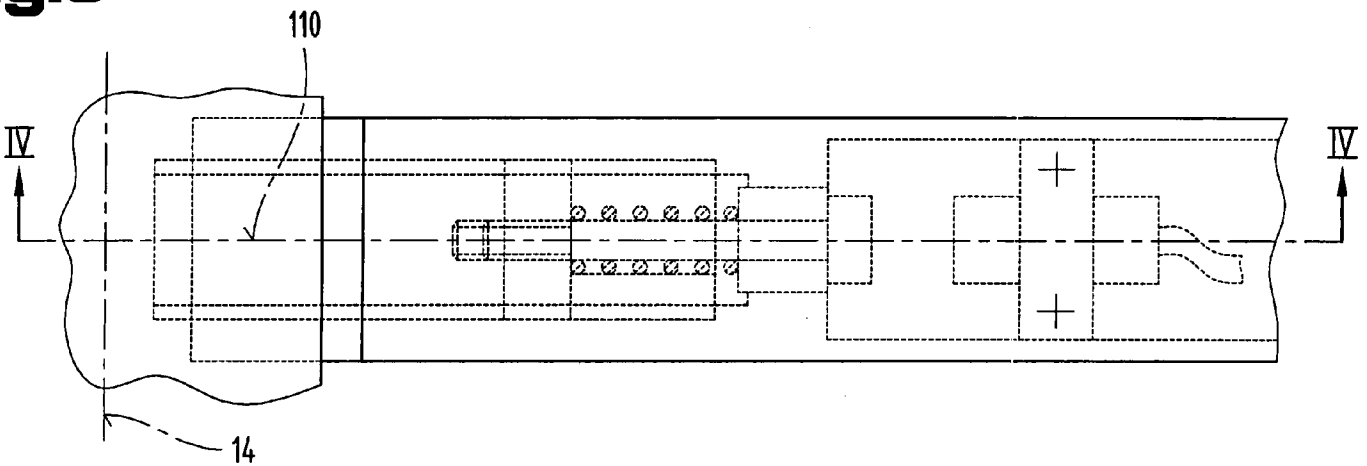
FIG. 5 is a top view of the positioning system according to FIG. 4.

Now, FIGS. 4 and 5 show the stop finger 96 of the positioning system 66 in detail. A finger carrier 99 cantilevered in the direction of the folding plane 14 is secured in the carriage arrangement 94. The finger carrier 99 is substantially formed by a U-shaped section with a base leg 100 and the side legs 101. In an end area 102 facing the folding plane 14, a stop element or finger insert 104 projecting beyond the finger carrier 99 is adjustably supported in a longitudinal guide formed by the guide grooves 103. Said finger insert 104 is adjustable against the force exerted by a spring arrangement 105, for example a coil pressure spring, in the direction perpendicular to the folding plane 14. In its extended end position, said finger insert is limited by a stop arrangement 106. At an end protruding beyond the finger carrier 99, the finger insert 104 has a step-like recess 108, which forms a stop surface 109 for the sheet bar 3, said surface extending parallel to the folding plane 14. Furthermore, a scanning pin 111 extending in about the area of a longitudinal center axis 110 in the direction opposite to the stop surface 108, is arranged fixed in the finger insert 104, said pin being enclosed by the coil pressure spring of the spring arrangement 105. A contact switch, which may be an approximation sensor or distance-measuring sensor 115, is associated with a spacing 114 in the finger carrier 99 with the scanning pin 111 or a front surface 113 formed in an end area 112. Said contact switch is line-connected with the controlling and/or monitoring system 67, for example via a line. Wireless signal transmission from the distance-measuring sensor 115 to the controlling and/or monitoring system 67 is naturally possible via suitable transmitting and receiving elements as well.

The figures show, furthermore, that the finger insert 104 and the stop surface 109 jointly form a variable stop means that can be adjusted to a fixed position set according to the manufacturing data for the workpiece.

Figure 6:
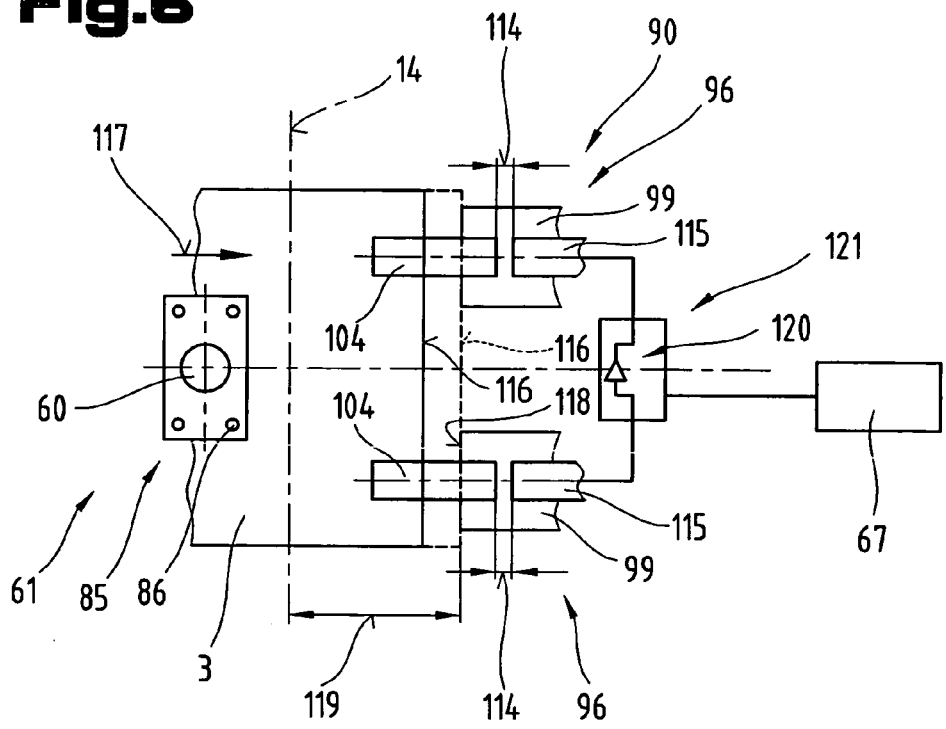
FIG. 6 is a diagrammatic representation showing how the sheet bar is positioned in the positioning stem.

A positioning operation is schematically shown in FIG. 6. In conjunction with a determination of any difference that may exist in the spacing between at least two stop fingers 96 of the stop arrangement 106, said fingers being spaced from one another, the position of the sheet bar 3 is corrected with the rotational system 60 in a first positioning step, in which the sheet bar 3 is brought into a predetermined position in relation to the folding plane 14, for example with a front surface 116, whereby said position may be parallel, but also angular relative to said folding plane, by rotating the vacuum gripping system 65 by means of the rotating unit 60 as required. Following such a preliminary adjustment of the front surface 116 with respect to the folding plane 14, the sheet bar 3 is adjusted with the gripping system 61 as indicated by an arrow, as the finger insert 104 is being elastically engaged by a stop plane 118 that is aligned parallel to the folding plane 14, as shown by way of example. In this way, an exact folding distance 119 is obtained between the face edge 116 and the folding plane 14, such distance being desired for the folding process. By pressing the face edge 116 against the stop plane 118, which is formed by the finger carrier 99, any other inaccuracies that may still exist following the rotation with the rotating unit, can be compensated by the elasticity of the suction cups 86 without requiring implementation of any other controlled adjustment measures. This results in a reduction of the cycle time in the manufacturing sequence. A comparator circuit 120 of the distance-measuring system 121 serves for determining the different adjustment distances found on the stop fingers 96 by means of the sensors 115 measuring the spacing or distance. Said measuring system 121 is connected to the sensors 115 measuring the spacing, and to the controlling and monitoring system 67 via lines, whereby said elements may be designed also for wireless signal transmission, as already stated above.

The position of the sheet bar 3 with its front surface 116 with respect to the folding plane 14, is normally corrected in a simplified embodiment by a contact switch 115, which is provided in the stop arrangement 106. With angular approximation of the face edge 116 of the finger inserts 104, one of the contact switches—which are spaced from one another—will respond first. According to a signal issued by said contact switch, the rotary unit 60 is caused to rotate in the direction of a further contact switch 115, and the sheet bar 3 is rotated for compensating the angular position until said further contact switch will respond as well, which completes the preliminary positioning of the sheet bar 3 or face edge 116. The expenditure in terms of control technology, which is more extensive when measuring sensors are employed with the required comparator circuit 120, is simplified in such a design variation, and the same technical effect is realized at lower cost.

Figure 7:
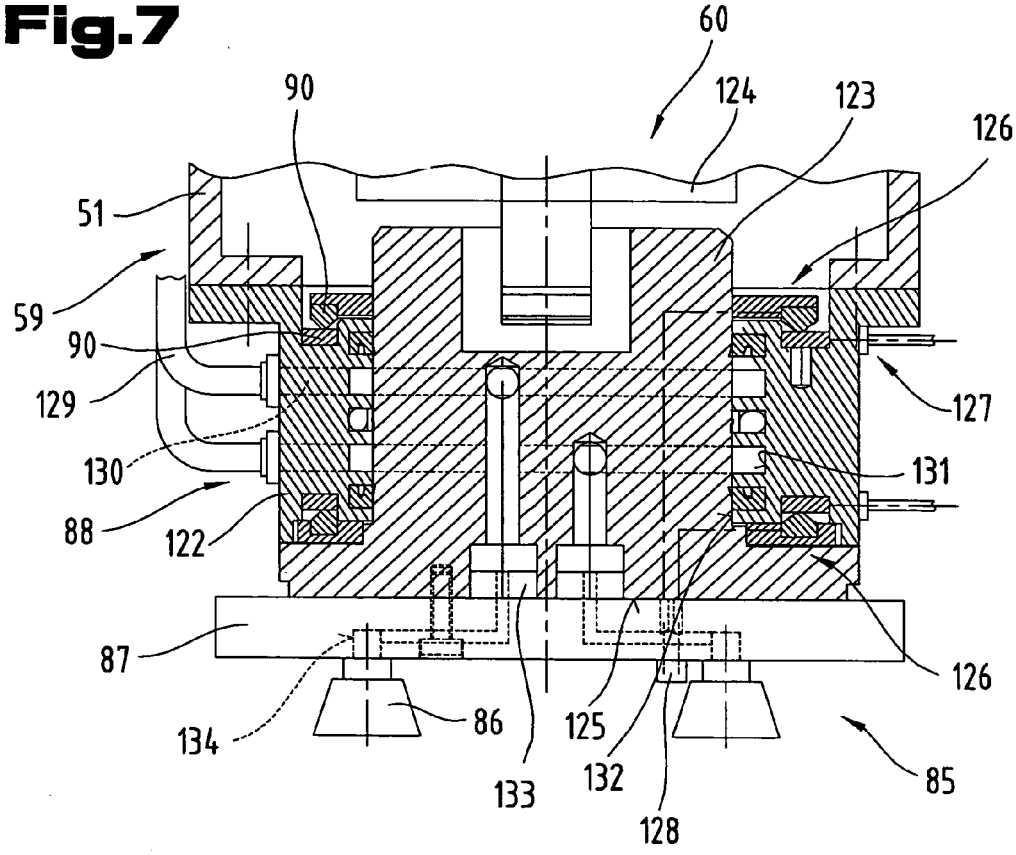
FIG. 7 is a sectional representation of a detail of a rotating transmitter for control signals, and of a medium of the manipulating system of the manufacturing system as defined by the invention.

Furthermore, FIG. 7 shows the rotary transmitter 88 for transmitting control signals and/or energy and supply for the vacuum gripping system 85 with unlimited rotational movement of the gripper system 61. The rotary transmitter is formed by a tubular jacket housing 122, which is secured on the hinged arm 51 via a flange-like element. In said jacket housing, a rotational insert 123 is rotationally supported via a bearing arrangement not shown in detail, and coupled for rotation with a rotation drive 124. The gripper plate 87 fitted with the suction cups 86 is secured on a front surface 125 of the rotational insert 123, said front surface being disposed opposite the rotation drive 124.

Now, in order to transmit energy at least in a two-pole manner, but also signals, provision is made for at least two slip-ring arrangements 126, which are arranged in the form of a ring in the jacket housing 122, embracing the rotational insert 123, and forming a permanent line connection between the stationary connection means 127 on the jacket housing 122, and the connection means 128, e.g. on the rotating gripper plate 87.

For admitting the required vacuum to the suction cups 86, the stationary supply lines 129 for feeding compressed air are connected to the jacket housing 122. Said supply grooves 131 extending all around in a bore 132 of the jacket housing 122 receiving the rotational insert 123. In the rotational insert 123, provision is made for the further connection bores 133, which are associated with the grooves 131 for producing a flow connection with the connecting means 128 of the gripper plate 87, which is provided with the further supply bores 134 for admitting vacuum to the suction cups 86. It is noted, furthermore, that sealing rings or gaskets are arranged in the jacket housing 122 for tight sealing between the grooves 131, and also between the grooves 131 and the external environment, such gaskets surrounding the rotational insert 123. Said gaskets consist of a material with a low friction factor. Furthermore, the slip-ring arrangements 126 are naturally accordingly insulated against the jacket housing 122 and versus the rotational insert 123.

Figure 8:
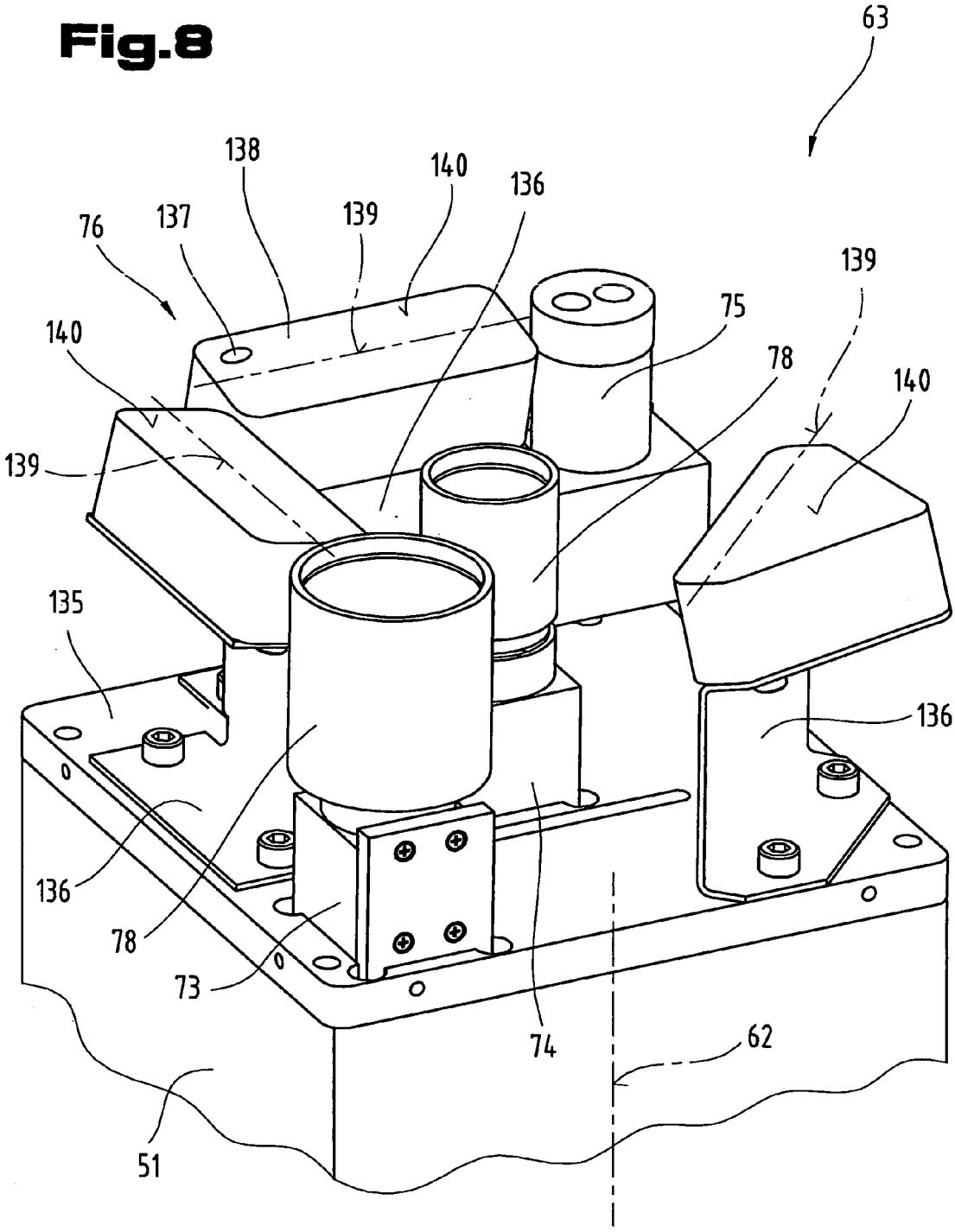
FIG. 8 is a representation of a detail of an acquisition system of the manufacturing system as defined by the invention.

Now, FIG. 8 shows in detail the detection system 63 without any protective cover, said system being arranged on the hinged arm 51. The illuminating heads 138 fitted with the LED's 137 and forming the illumination system 76, are secured via the mounting angles 136 on a carrier plate 135, which is connected and fixed for moving with the hinged arm 51. The longitudinal axes 139 defining the fields of light radiation are jointly forming a right angle between two of the total of three illumination heads 138, and are each forming with the longitudinal axis 139 of the third illumination head 138, an angle of about 45°. Each light exit surface 140 of the illumination heads 138 is inclined versus a plane extending perpendicularly at a right angle to the longitudinal axis of the hinged arm 51 within an angle range of from about 15° to 45°, in a manner such that the fields of light radiation are aligned conically against each other as the distance from the detection system 63 increases.

Furthermore, as already described above, the detection system 63 comprises the camera 73 for rough recognition, with the lens 78, which preferably has a focal length of 6 mm, as well as the camera 74 for fine recognition, with the lens 78, which preferably has a focal length of 16 mm.

Furthermore, the diode laser 75 for projecting a laser cross on the surface of the sheet bar 3, is arranged on the carrier plate 135. Said diode laser is employed for determining the distance between the detection system 63 and the sheet bar 3 to be photographed, as already described above as well.

Figure 9:
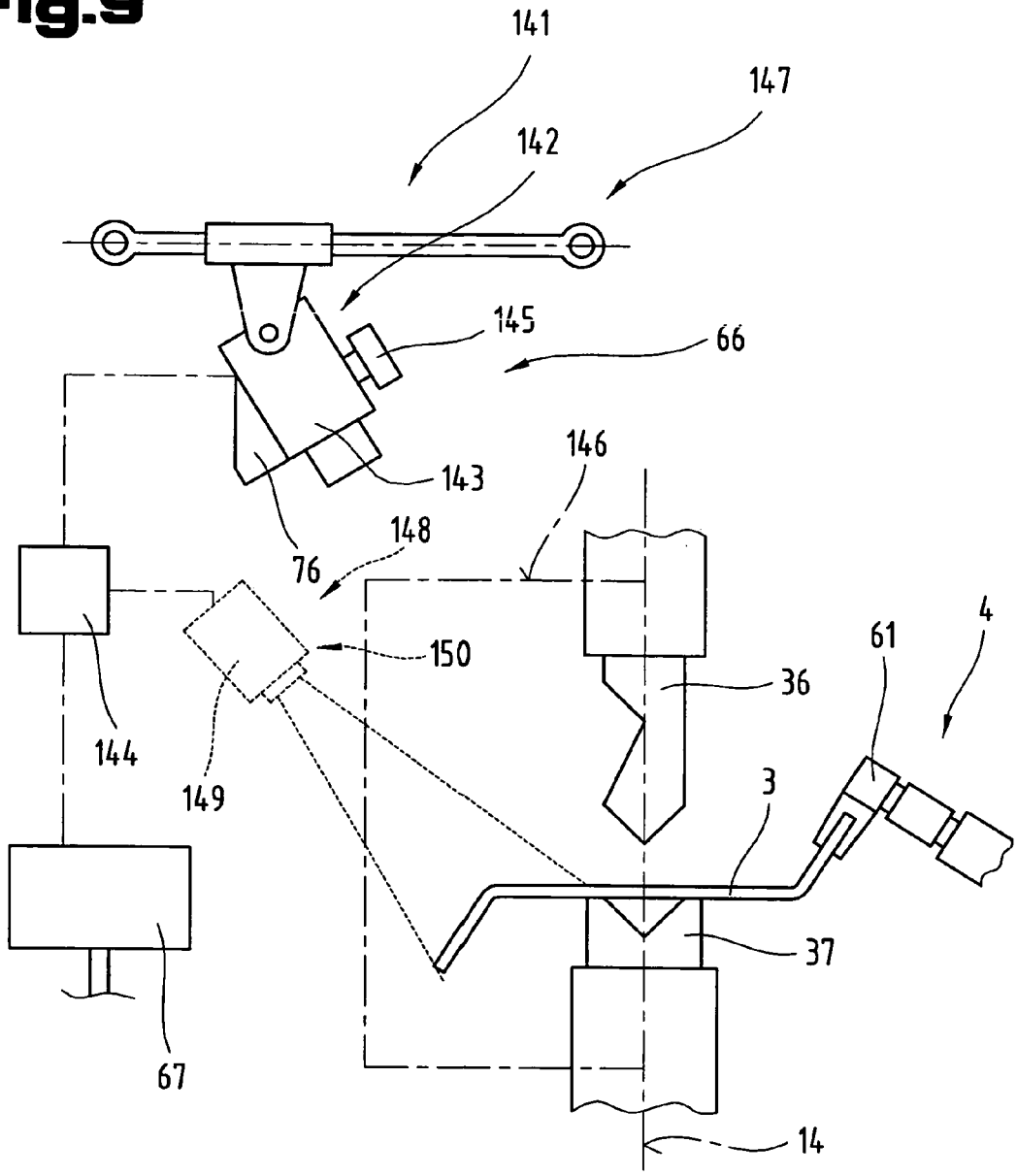
FIG. 9 is a schematic representation of a positioning system of the manufacturing device as defined by the invention.

Now, FIG. 9 shows another embodiment of the positioning device 66 for positioning the sheet bar 3 without contact by means of the manipulating device 4 between the folding dies 36, 37. Said positioning device is provided in the realizable form of an optoelectronic measuring device 141. Furthermore, a method for positioning the sheet bar 3 is described with the help of FIG. 9. The optoelectronic measuring device 141 is substantially formed by at least one image acquisition means 142, for example a CCD camera 143, and a computer 144, which is line-connected with the image detection means 142 and the controlling and monitoring system 67 of the folding press 2. The image acquisition means 142 is combined, for example with a laser scanner 145 and the illumination system 76. The unit so formed is designed for acquiring without contact an ACTUAL position of a contour area of the press space 146—the latter being refined with respect to the folding plane 14—with the manipulating device 4 for a folding operation on the sheet bar 3 inserted between the folding dies 36 and 37, and several of such units may be selectively installed in a fixed manner. In the example shown, one unit is displaceably arranged on a two-coordinate, linear carriage arrangement. However, it is possible also to employ a multi-axis manipulator for using the unit.

A displaceable arrangement permits using simplified technical equipment for the optoelectronic measuring device 141 because the image acquisition means 142 can be positioned in accordance with the manufacturing program near the sheet bar 3 inserted in the press space 146 for determining the position data of the sheet bar.

With a fixed installation, several image acquisition means 142 are required depending on the size of the press space 146.

The positioning of the sheet bar 3 between the folding dies 36, 37 for obtaining a canting, is carried out by acquiring the contour area of the sheet bar 3 that is decisive for the folding process in accordance with the data preset in the manufacturing program for producing the workpiece. Said preset data are preferably obtained in an online operation from the CAD sector. By means of the positioning device 66, the sheet bar 3 is inserted with the help of the manipulating device 4 until an actual position of the respective area of the contour corresponds with the reference data of a nominal or should-be position of the respective area of the contour. Said reference data are stored in a memory of the computer 144 or controlling and monitoring system 67. The positioning process is executed by controlling the adjusting system 69 of the manipulating device 4 for executing the operational sequences.

Other possibilities for contactlessly positioning the sheet bar 3 between the folding dies 36, 37, such positioning taking place via the determination of the space coordinates by means of a coordinates acquisition device 148 of the sheet bar 3, include the application of the triangulation sensors 149 known from the prior art, or comprise the utilization of the photosensors 150 instead of employing the image acquisition means described above.

Both methods permit contactless measuring or position acquisition, whereby a beam of the laser diode is focused on the workpiece through a lens. The scattered light emitted at a defined angle is absorbed via a shutter by a detector system, for example a CCD line array. The given actual data of the position, e.g. of a contour configuration of the sheet bar 3, are determined by trigonometric computation of the course of the beams and scattered light, and conciliated with the stored nominal data by controlling the manipulating system 4 and/or the gripping system 61.

The light interface method with the application of the photosensors 150 employs a laser beam for contactless data acquisition as well, such a laser beam being linearly widened and projected onto the sheet bar 3 by a laser diode via a focusing lens. The scattered light is projected via a reproducing lens onto a CCD matrix, whereby a surface array is used instead of the line array. In addition to determining the space coordinates of an area of the contour, said method is suited also for controlling the folding angles of preceding folding operations.

Figure 10:
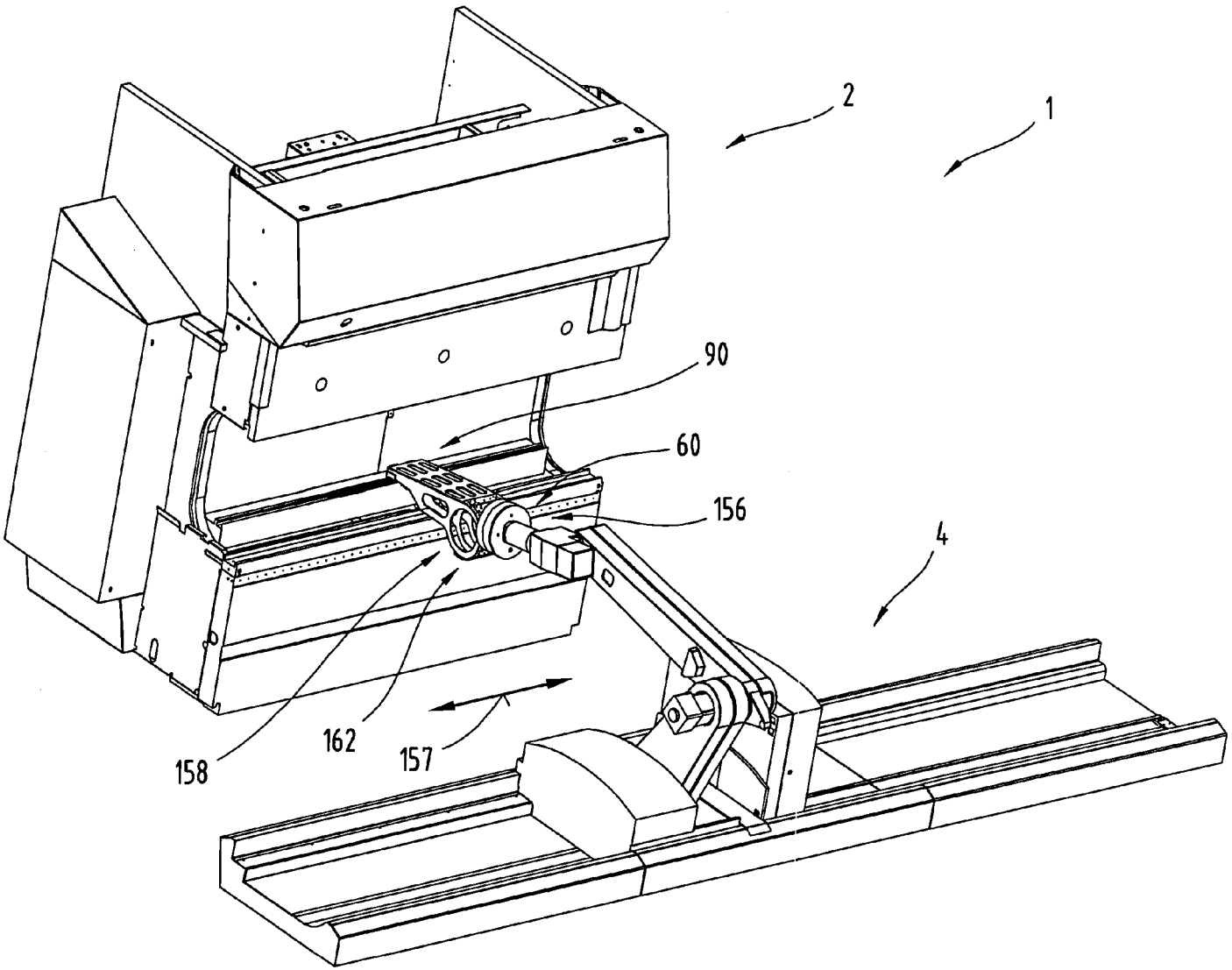
FIG. 10 is a schematic representation of an arrangement as defined by the invention of a measuring system for calibrating the manipulating device of the manufacturing system.
Figure 11:
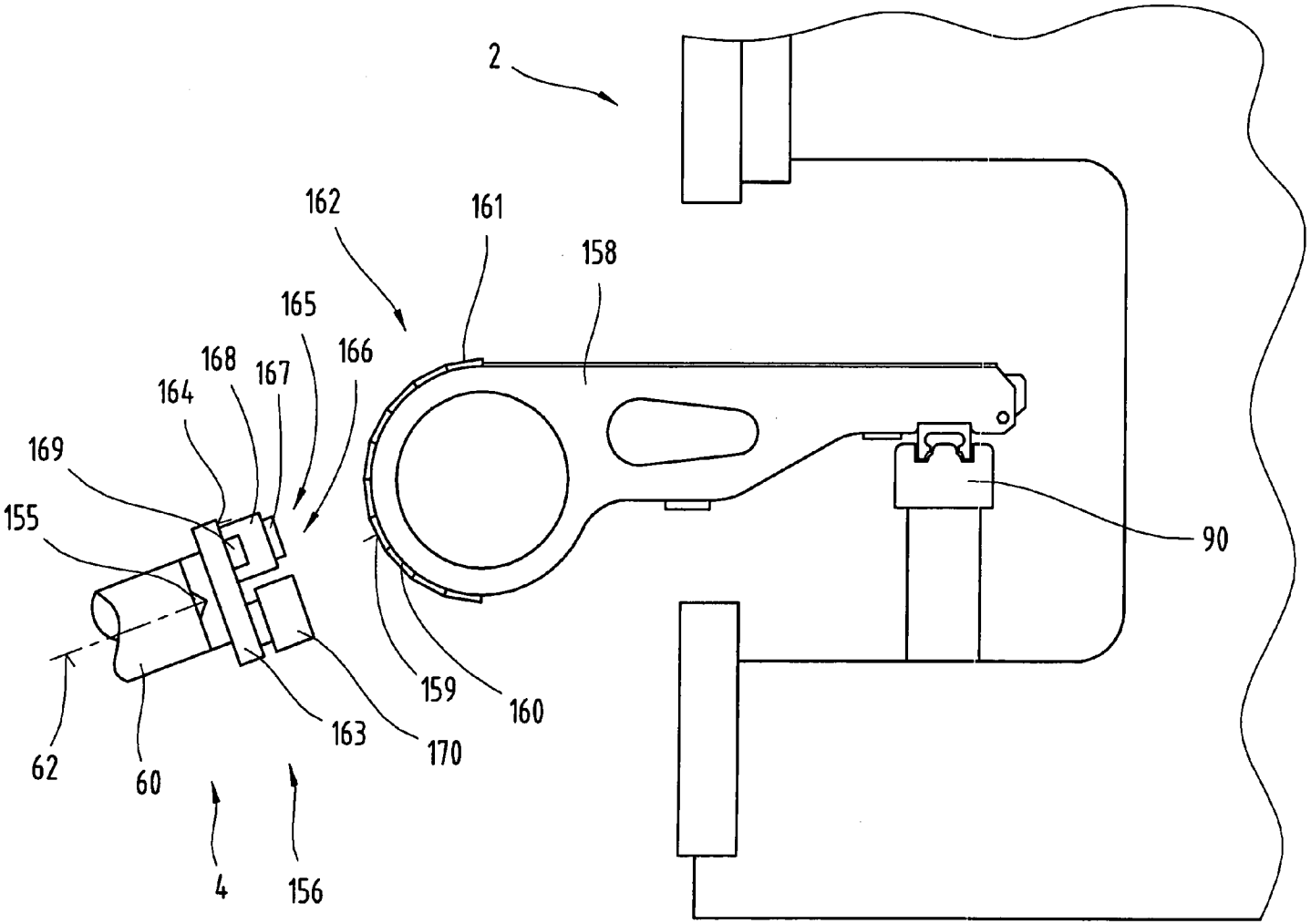
FIG. 11 is a view of a detail of the measuring system and of a reference body of the manufacturing device.

Components for calibrating the manipulating device 4, and, furthermore, the calibration method are now explained in the following with the help of the system arrangement of the manufacturing system 1 formed by the folding press 2 and the manipulating device 4 as shown in FIGS. 10 and 11. So that offline programming can be carried out, it is additionally necessary for the basic calibration of the manipulating device 4 to compensate load-conditioned deviations of the position that may occur in actual folding operations.

The manipulation of workpieces in folding operations carried out on a folding press requires that exacting requirements have to be met with respect to the accuracy of the manipulating device 4 in order to manipulate the workpieces, e.g. the sheet bar 3, from the time it is received from its ready-for-processing position and positioned in the working space of the bending press 2, and guided in the course of the folding process, and, furthermore, until the processed, folded workpiece is deposited in an oriented manner. Particularly absolute accuracy during positioning and guiding of the workpiece will directly affect the manufacturing accuracy. Now, in order to assure such absolute accuracy accordingly for all of such processes involved in a manufacturing sequence, and in the positioning of the workpiece in the working space of the press, provision has to be beneficially made for upstream calibration of the manipulating device 4 and the folding press 2. For said purpose, the manipulating device 4 is fitted according to the invention with a measuring system 156 on a positioning means 155 normally positioning the gripper system 61. In the folding press 2, a reference body 158, which is manufactured with high dimensional accuracy, is mounted in the stop device 90 in the preset position of the Z-axis as indicated by the double arrow 157. Said reference body, which is facing the manipulating device 4, is provided with a multitude of the reference means 159, which have exactly preset and fixed positions and coordinates in terms of space with respect to the position assumed by the stop device 90. The reference means 159 are preferably formed by the bores 160 in a multitude of the carrier metal sheets 161. The latter are lined up at an angle in a row along a circumference, forming a type of drum, with the surfaces facing the measuring system and the reference means 159 provided in said surfaces in a measuring range 162 for the calibration process.

The measuring system 156 is comprised of a carrier plate 163, which is mounted on and fixed for rotation with the rotational system 60 of the manipulating device 4. On a plane surface 164 facing the reference body 158, a camera, particularly a CCD camera 166, is arranged on the carrier plate 16 eccentrically in relation to the rotational axle 62 of the rotational system 60. The lens 167 of said camera is surrounded by a ring lamp 168. Furthermore, for determining the exact spacing with respect to the reference body 158, provision is made for a measuring instrument 169 measuring the spacing of the laser.

Furthermore, FIG. 11 shows that for simulating an actual operation, in which the manipulating device 4 is loaded with a sheet bar 3, provision is made on the carrier plate 163 for the arrangement of a reference weight 170 for determining the effects acting on the positioning process on account of the weight of the workpiece and caused by the elastic deformations of the manipulating device 4. In at least two simulation processes, in which different reference weights 170 are used, the reference means 159 are targeted one after the other, and the compensation values conditioned by the load obtained from the nominal/actual comparison of the positioning, are stored in the control system or memory of a computer in a compensation matrix. In the actual operation, the actual compensation values are determined based on the results of said comparison by interpolation in accordance with the actual and known weight of the workpiece to be folded, and corrected postures of the robot are generated, which insures constantly exact positioning of the sheet bars 3 or work-pieces in the working space of the folding press 2.

The calibration process is generally explained in greater detail in the following based on the following calibration steps, taking into account the load of the manipulating device 4, particularly the robot:

(1) Modeling of the robot.

Generation of a displacement program.

Measurement of the deviations in the positioning of the robot.

Identification of the parameters of the robot model.

Correction of the displacement program.

1. Modeling of the Robot

In the simplest case, the robot is modeled with the help of a calibration software that is basically capable of taking into account the influences that have to be compensated, or their effects on the components of the robot. In the present case, the influences include tolerances in the assembly and manufacture of the robot, as well as of the entire arrangement, which have effects on the following:

Coordinate transformations between the components of the arrangement (comprising the robot, the machine and the reference bodies).

The kinematic chain and the transmission behavior of the drives of the robot, as well as load effects caused by the individual mass of each of the elements of the kinematic chain of the robot, and of useful or additional loads flanged to the wrist of the robot, with effects on the positioning accuracy of the robot due to unknown or only insufficiently known elasticity factors of the drives and elements of the kinematic chain of the robot.

The mathematical model can be generated also independently of any preset software.

It must be possible with the mathematical model to represent the positioning behavior of the robot in the working space in dependency of the influences to be compensated, or their effects on the components of the robot.

2. Generation of a Displacement Program for Measuring the Positioning Errors Caused by Influences Exerted by Load as Well as Assembly and Manufacturing Tolerances For such generation, the position and orientation data in the space, machine and basic robot systems of coordinates of known points (known from measurements or by securing an adequately high manufacturing accuracy), for example on a reference body 161, are processed to a robot displacement program in a manner such that the positioning errors of the robot caused by the aforementioned influences can be measured at said points with the help of the displacement program with a measurement system 159 adapted to the robot. For this purpose, the points have to be represented in the form of suitable measurement features, e.g. in the form of the bores 160 serving as the reference means 162.

Alternatively, it is possible also to use a measurement feature with an external measuring system (e.g. laser tracker, Theodolit etc.) that is mounted on the flange of the robot.

(Note: As far as the use of any desired points in the space in conjunction with an external measuring system is concerned, this step is a component of the normal procedure for calibrating a kinematic chain. The generation of a displacement program on a reference body is used in identical form within the framework of a temperature drift program).

3. Measurement of the Positioning Deviations of the robot With the Help of the Displacement Program In the present step, the positioning errors of the kinematic chain at the measuring points are measured with the help of a measuring system and the displacement program generated in item 2 above. The measured data are output (if necessary also by conversion) in a system of coordinates fixed in the space, with known (if possible) reference to the basic system of coordinates of the robot.

As opposed to the conventional procedure for calibrating kinematic chains, this process is carried out two times, with different additional loads flanged to the wrist of the robot. Different measurement data are obtained in this way depending on the given additional load.

4. Identification of the Parameters of the Robot Model (Parameter Identification, Determination of the Actual Values of the Parameters of the Robot Model As it is usually done in the conventional calibration of the robot, the coordinate transformation of the system of coordinates of the measuring points used, into the basic system of coordinates of the robot, is determined first. This is carried out with the help of the measurement data record (measurement data record No. 1) from step 3 above, with the help of, for example a "bestfit" method, or simply by determining the mean deviations in the individual coordinate directions.

The measurement data record No. 1 is transformed into the basic system of coordinates of the robot with the help of the determined coordinate transformation.

Subsequently, the elasticity parameters are identified first with the help of calibration software, and the other parameters of the kinematic chain to be identified are identified in a second step with the help of the transformed measurement data record No. 1.

With the help of the identified robot model as well as the previously determined transformation of the coordinates, the positioning errors that have to be expected under the following conditions are now calculated (with the calibration software) in the sense of a simulation:

(a) The identified parameters are not taken into account by the robot control; however, they do have an effect on the positioning behavior of the kinematic chain considered. Said parameters are therefore used for calculating the positions actually assumed by the simulated kinematic chain.

(b) The displacement program generated in item 2 above is applied as the basis in conjunction with the measuring points used for the measurements in item 3 above. The measuring points are approached (quasi in the form of a mathematical simulation) with exactly the same postures preset by the position-setting values of the kinematics as in the real measurement.

(c) The additional weight used in item 3 for measuring the positioning errors in the second record of measured data (measured data record No. 2) is taken into account in the calculation. This conforms to a change in the load conditions vis-a-vis the identification conditions, the real effect of which is known from the measurement carried out in item 3 above (measured data record No. 2).

Said calculated positioning errors are now compared with the actual positioning errors from the measured data record No. 2 determined in item 3 above. It is sufficient in this connection to evaluate the proportions of the difference between the data records (simulated and measured data) in the direction of the effect of the force of gravity.

Now, either the averaged deviation between the two data records, or the sum of the squared errors of said deviations, can be used as the optimization criterion.

In the case of the average deviation, the latter has to be as close as possible to the zero value; in the case of the evaluation of the squared errors, the minimum of the sum of the squared errors has to be found.

Thereafter, the transformation of the coordinates (of the system of coordinates of the measuring points used, into the basic system of coordinates of the robot) determined at the outset with the help of the measured data record No. 1, is systematically changed step by step in the sense of an approximation method, by varying (at least) the proportion of the transformation in the direction in which the force of gravity is acting.

Following each variation, the transformation that has changed is again applied in each case to the non-transformed measured data record No. 1. As already explained above, the elasticities are first identified again with the measured data record so transformed, and subsequently then the remaining parameters of the robot model that have to be identified. Thereafter, the mathematical positioning errors are calculated again with the newly identified model for the displacement program generated in item 2, under the conditions specified above, and compared with the deviations in the measured data record No. 2.

Said loop is run through until one of the optimization criteria specified above has been satisfied.

The background of this procedure is as follows:

Since the measured data are recorded only within a small area of the working space, the positioning errors caused by elasticities are often hardly distinguishable from the effects exerted of other influences. The robot is flexed within the entire measuring range to similarly high degrees, so that in the identification of the parameters, it is impossible only with the help of the values measured for a load condition to recognize which proportion of the deviation has to be attributed to a consequence of flexural bending, and which proportion thereof has to be ascribed to other parameters including the transformation of the coordinates. As a rule, therefore, the robot is identified as being stiffer than it actually is. In order to compensate this deficit, the result of an identification of the parameters is reviewed with the help of the data measured for another load condition. The residual deviation caused by the flexing of the robot in the measured data record is subsequently increased via the change in the transformation of the coordinates, and reliably allotted to the elasticity parameters via the exclusive identification of the elasticities in the first step. The remaining parameters can then be identified based on the identified elasticities.

5. Correction of the Displacement Program

The displacement program is corrected again as it is normally done in the conventional calibration of kinematic chains.

For the sake of good order, it is finally noted that in the interest of superior understanding of the structure of the manufacturing system, the latter and its components are partly represented untrue to scale and/or enlarged and/or reduced.

The problems on which the independent inventive solutions are based can be derived from the specification.

Most importantly of all, the individual embodiments shown in FIGS. 1 to 11 may form the objects of independent inventive solutions. The problems and solutions as defined by the invention in relation to such objects are specified in the detailed descriptions of said figures.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A manufacturing system for workpieces in the form of sheet metal bars shaped by folding, comprising:

a folding press having two press beams adjustable in relation to each other and provided with folding dies;

an automated manipulating device comprising a rotating unit and a gripping device and displaceable on a guiding arrangement in the direction of a longitudinal axis of the press beams;

a positioning device for positioning workpieces between the folding dies; and a controlling and monitoring system, wherein the manipulating device comprises three hinged arms connected via swiveling devices to form a hinged-arm arrangement, wherein an end of a first hinged arm is pivot-mounted by a swiveling device mounted on a linearly displaceable chassis of the guiding arrangement such that the first hinged arm is pivotable about a swivel axle extending parallel to a guiding track of the guiding arrangement; a second and a third swivel axle of the swiveling devices supporting the hinged arms are arranged extending parallel to the swivel axle of the swiveling device on the chassis; the rotating unit, having a rotation axle extending perpendicularly to the swiveling axles, is arranged in another end area of the hinged-arm arrangement; an image acquisition system is arranged in the end area of the hinged-arm arrangement, said acquisition system comprising at least one image-acquiring means and at least one illumination system and one laser for identifying and recognizing the workpieces; and the positioning device is formed by a stop device with at least two stop fingers adjustably arranged on a backside of the folding dies facing away from the manipulating device in a plane disposed parallel to the folding plane and in the vertical direction in relation to said plane, the stop fingers having finger carriers and finger inserts adjustable in said finger carriers to a spacing in relation to sensors measuring said spacing.

2. The manufacturing system according to claim 1, wherein each adjustable finger insert defines a stop surface forming a variable stop, and is adjustable against the force of a spring arrangement in a stop plane formed by the finger carrier in a direction perpendicular to the folding plane.

3. The manufacturing system according to claim 1, wherein each sensor measuring the spacing is arranged on the respective finger carrier spaced from a scanning pin connected to move jointly with the respective finger insert.

4. The manufacturing system according to claim 1, wherein the sensor measuring the spacing is connected to at least one of a comparator circuit and the controlling and monitoring system via lines.

5. The manufacturing system according to claim 1, wherein the sensor measuring the spacing is wirelessly communicatively connected to at least one of a comparator circuit and the controlling and monitoring system.

6. The manufacturing system according to claim 1, wherein the camera is a CCD camera.

7. The manufacturing system according to claim 1, wherein the illumination system arranged on the acquisition system is formed by three illumination heads with a plurality of LEDs for light rays in the infrared frequency range, said LEDs being arranged angularly offset relative to one another; and a light exit surface is arranged to be inclined in relation to a surface of the workpiece.

8. The manufacturing system according to claim 1, wherein the illumination system is an infrared radiation source designed for a frequency range of from about 750 to 1000 nm.

9. The manufacturing system according to claim 1, wherein the diode laser is designed for an output of about 5 megawatts at 650 nm.

10. The manufacturing system according to claim 1, wherein a rotational transmitter for signal and/or energy transmission and for transmitting a medium is arranged between the rotating unit and the gripping system.

11. The manufacturing system according to claim 10, wherein the rotational transmitter is fitted with transmission elements for transmitting signals and/or energy and endless rotational motion.

12. The manufacturing system according to claim 10, wherein the transmission elements for signals are designed for at least two-channel transmission of energy and medium.

13. The manufacturing system according to claim 10, wherein the transmission elements or signals are designed for ASI bus transmission.

14. The manufacturing system according to claim 10, wherein a sealing arrangement is formed between the transmission elements by slip rings made of low-friction material.

15. A method for operating a manufacturing system according to claim 1, wherein after a workpiece has been identified and the workpiece's position been recognized by the acquisition system, the workpiece is picked up by the gripping device of the manipulating device and brought to rest with a stop edge against the stop fingers of the stop device between the press beams having the folding dies, projecting through a folding plane in the vertical direction relative to said folding plane, each of said stop fingers being adjustable against the force of a spring arrangement and the stop fingers being spaced from each other in the longitudinal direction parallel to the longitudinal axis of the folding beams; the amount of displacement of the stop fingers required for adjusting the stop fingers is determined via a spacing-measuring sensor, such sensor being assigned to each stop finger; and an angular position of the stop edge with respect to the folding plane is determined based on such determination; an angular deviation of the stop edge from a predetermined angular position is adjusted by means of the rotating unit of the gripping device; and the workpiece is subsequently adjusted for resting with the stop edge of the workpiece against a fixed stop or against a preset final stop position of the finger carriers.

* * * * *